US011758986B1

(12) United States Patent
Gooch et al.

(10) Patent No.: US 11,758,986 B1
(45) Date of Patent: Sep. 19, 2023

(54) TACTILE FEEDBACK MAGNETIC CLOSURE DEVICE

(71) Applicants: Ashley Houghtaling Gooch, Houston, TX (US); Jennifer Jones Zimmer, Austin, TX (US)

(72) Inventors: Ashley Houghtaling Gooch, Houston, TX (US); Jennifer Jones Zimmer, Austin, TX (US)

( * ) Notice: Subject to any disclaimer, the term of this patent is extended or adjusted under 35 U.S.C. 154(b) by 0 days.

(21) Appl. No.: 17/872,043

(22) Filed: Jul. 25, 2022

(51) Int. Cl.
*A44B 1/02* (2006.01)

(52) U.S. Cl.
CPC ..... *A44B 1/02* (2013.01); *A44D 2203/00* (2013.01)

(58) Field of Classification Search
CPC .... A44B 1/02; A44B 1/04; A44B 1/08; A44D 2203/00
See application file for complete search history.

(56) References Cited

U.S. PATENT DOCUMENTS 2,648,884 A * 8/1953 Loofboro ..... A44C 5/2071 24/303
7,120,972 B2 * 10/2006 O'Banion ..... A44C 1/00 24/303
9,159,251 B2 * 10/2015 Berry ..... A41F 1/002

* cited by examiner

*Primary Examiner* — Robert Sandy
(74) *Attorney, Agent, or Firm* — Pharar Patents & Intellectual Property; Andrew A. Pharar

(57) ABSTRACT

The tactile feedback magnetic closure device disclosed herein may include a pair of magnets having distinct tactile components that indicate to a user which magnet should be placed outside of the other for proper alignment of clothing flaps. These tactile components may vary, as desired, but may generally include a protrusion, or arrangement of protrusions, or a depression, or arrangement of depressions, in or attached to the magnets themselves. The tactile feedback magnetic closure device may include any appropriate magnetic, resilient, waterproof, and heat-resistant material and may be attached to, or integrated into, an article of clothing. The device is designed to overcome the shortcomings in the prior art, which specifically include the lack of ability to determine that the magnetic closure is correctly aligned when the user cannot visually confirm its alignment.

10 Claims, 15 Drawing Sheets

TACTILE FEEDBACK MAGNETIC CLOSURE DEVICE

TECHNICAL FIELD OF THE INVENTION

The present invention relates in general to magnetic closures, and, more specifically, to a tactile feedback magnetic closure device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

A onesie is an article of clothing that, typically, comprises a single-piece bodysuit. The term is derived from "onesies", which is a brand name used for infant bodysuits, but that has since been genericized to generally refer to all such articles of clothing. Adult onesies, which have become popular as a type of streetwear, usually incorporate a torso having upper and lower body coverings and, often, integrated covers for the user's hands and feet. A subtype of the onesie, known as kigurumi, may comprise various features from animals or other characters that are worn as a type of fashion or self-expression.

To wear a onesie a user may first place their legs into the lower half of the bodysuit and then place their arms into the upper half of the bodysuit. To close the onesie the user is often provided with an integrated zipper, buttons, button snaps, hooks, or other similar types of closure mechanisms. To close a zipper the user often aligns the two chain halves of the mechanism into the slider component and then pulls the slider upwards, creating a toothed bond. Closing a button generally involves aligning and inserting a button on an inner flap of the article of clothing into a slit on the outer flap, while closing button snaps requires the user to align and insert a first button half into a second button half. A hook on a first flap of clothing is usually inserted into a loop on a second flap of clothing.

Such closure mechanisms are found ubiquitously in various types of clothing. By way of example, shirts, sweaters, jackets, pants, hoods, and capes may also include one or more variations of zippers, buttons, button snaps, and hooks. Such closure mechanisms are generally used for these purposes because, inherent in their design and functionality, they provide a user with a tactile reference and indication of how to make the closure and when the closure has been accomplished. A user can feel the ends of a zipper chain and insert one into the slider without the need to see the device, and a "zipping" sound notifies the user that the closure has been accomplished. The two components of a button and slit, or a hook and loop, vary so much in tactile feel that the user knows which half is to be inserted into, or hooked onto, the other. The two halves of a button snap can be felt by the user and have obvious variations so that the user knows which end is inserted into the other.

A less commonly used type of closure mechanism is that involving a pair of magnets. Usually a first magnet is inserted into, or attached to, a first or outer flap of an article of clothing, and a second magnet is inserted into, or attached to, a second or inner flap of clothing. The two magnets, each having a north pole and a south pole, are necessarily opposed to each other so that a magnetic bond may occur. The problem inherent in such a design, though, is that the first, or outer, magnet may not necessarily bond to the outer side of the second, or inner, magnet, because the magnetic bond can be created if either of the magnets is placed in either position. This problem presents itself, especially, in low-light or dark situations, or to visually-impaired users, when a user may not necessarily be able to visually confirm that the outer flap of the article of clothing is, indeed, bonded to the outer side of the inner flap of the article.

Articles of clothing intended for children, toddlers, and infants, especially, tend to employ magnetic closure mechanisms as they are strong enough that the wearer, being a small child, may not be able to open the closure mechanism but that the mechanism would separate on its own if the wearer becomes bound, tied, or choked by the article of clothing. Such wearers often cannot wear such an article of clothing on their own, and generally a parent or guardian is dressing the wearer in such clothing. Due to the problem inherent in such magnetic closures, especially when a parent or guardian is dressing the wearer in the dark, the risk of incorrectly closing such an article of clothing is significantly increased, which itself presents a risk of harm to the wearer.

Thus, there is a need in the art for a tactile feedback magnetic closure device that may comprise a pair of magnets having distinct tactile components that indicate to a user which magnet should be placed outside of the other for proper alignment of clothing flaps. These tactile components may vary, as desired, but may generally comprise a protrusion, or arrangement of protrusions, or a depression, or arrangement of depressions, in or attached to the magnets themselves. The tactile feedback magnetic closure device may comprise any appropriate magnetic, resilient, waterproof, and heat-resistant material and may be attached to, or integrated into, an article of clothing. The device is designed to overcome the shortcomings in the prior art, which specifically include the lack of ability to determine that the magnetic closure is correctly aligned when the user cannot visually confirm its alignment. It is to these ends that the present invention has been developed.

BRIEF SUMMARY OF THE INVENTION

To minimize the limitations in the prior art, and to minimize other limitations that will be apparent upon reading and understanding the present specification, the present invention describes a tactile feedback magnetic closure device.

It is an objective of the present invention to provide a tactile feedback magnetic closure device that may comprise an outer magnet.

It is another objective of the present invention to provide a tactile feedback magnetic closure device that may comprise an outer magnet north face.

It is another objective of the present invention to provide a tactile feedback magnetic closure device that may comprise an outer magnet south face.

It is another objective of the present invention to provide a tactile feedback magnetic closure device that may comprise a plurality of outer projections.

It is another objective of the present invention to provide a tactile feedback magnetic closure device that may comprise an outer enclosure.

It is another objective of the present invention to provide a tactile feedback magnetic closure device that may comprise a plurality of outer bindings.

It is another objective of the present invention to provide a tactile feedback magnetic closure device that may comprise an inner magnet.

It is another objective of the present invention to provide a tactile feedback magnetic closure device that may comprise an inner magnet north face.

It is another objective of the present invention to provide a tactile feedback magnetic closure device that may comprise an inner magnet south face.

It is another objective of the present invention to provide a tactile feedback magnetic closure device that may comprise a plurality of inner projections.

It is another objective of the present invention to provide a tactile feedback magnetic closure device that may comprise an inner enclosure.

It is another objective of the present invention to provide a tactile feedback magnetic closure device that may comprise a plurality of inner bindings.

It is another objective of the present invention to provide a tactile feedback magnetic closure device that may comprise a resilient material of construction.

It is another objective of the present invention to provide a tactile feedback magnetic closure device that may comprise a magnetic material of construction.

It is another objective of the present invention to provide a tactile feedback magnetic closure device that may comprise a water-proof material of construction.

It is another objective of the present invention to provide a tactile feedback magnetic closure device that may comprise a heat-resistant material of construction.

It is another objective of the present invention to provide a tactile feedback magnetic closure device that may comprise a reusable material of construction.

It is another objective of the present invention to provide a tactile feedback magnetic closure device that may comprise an antimicrobial layer.

It is another objective of the present invention to provide a tactile feedback magnetic closure device that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, or in reference to human anatomy in accordance with the present disclosure. Unless specifically set forth herein, the terms "a," "an," and "the" are not limited to one element, but instead should be read as meaning "at least one." The terminology includes the words noted above, derivatives thereof, and words of similar import.

The tactile feedback magnetic closure device disclosed herein may comprise a pair of magnets having distinct tactile components that indicate to a user which magnet should be placed outside of the other for proper alignment of clothing flaps. These tactile components may vary, as desired, but may generally comprise a protrusion, or arrangement of protrusions, or a depression, or arrangement of depressions, in or attached to the magnets themselves. The tactile feedback magnetic closure device may comprise any appropriate magnetic, resilient, waterproof, and heat-resistant material and may be attached to, or integrated into, an article of clothing. The device is designed to overcome the shortcomings in the prior art, which specifically include the lack of ability to determine that the magnetic closure is correctly aligned when the user cannot visually confirm its alignment.

Magnetism is a known natural phenomenon caused by the movement of electrons around an atomic nucleus. The spin of an electron creates a magnetic dipole, though most elements comprise electron pairs that cancel this net polarity. Some elements, such as iron, comprise unpaired electrons having angular momentum that is not offset by other electrons. These unpaired electrons create an inherent magnetic field that cause the element, or a compound derived from the element, to have a magnetic dipole moment resulting in a "north" pole and a "south" pole. The north pole of a first magnetic object is magnetically attracted to the south pole of a second magnetic object, while the north or south pole of a first magnetic object is repulsed by the north or south pole of a second magnetic object, respectively. It is known that heat exposure reduces the power and effect of this magnetic attraction.

Figure 1:
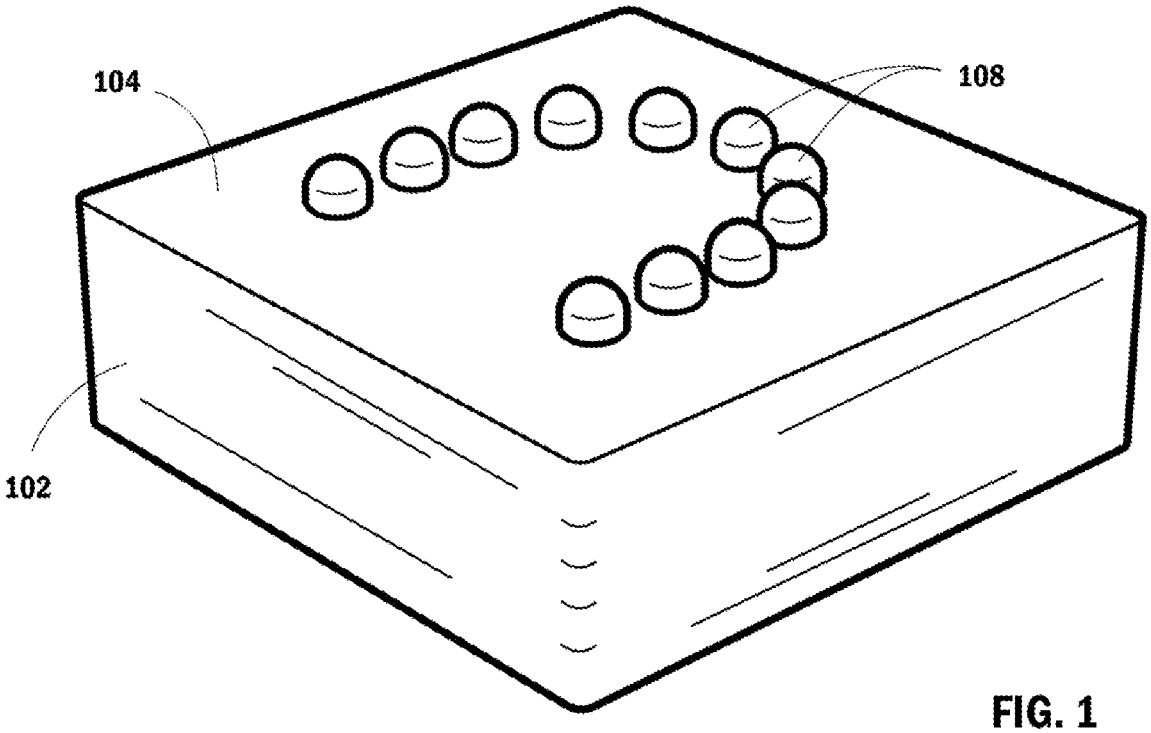
FIG. 1 is a top isometric perspective view of a first embodiment of an outer magnet of a tactile feedback magnetic closure device, as contemplated by the present disclosure.
Figure 2:
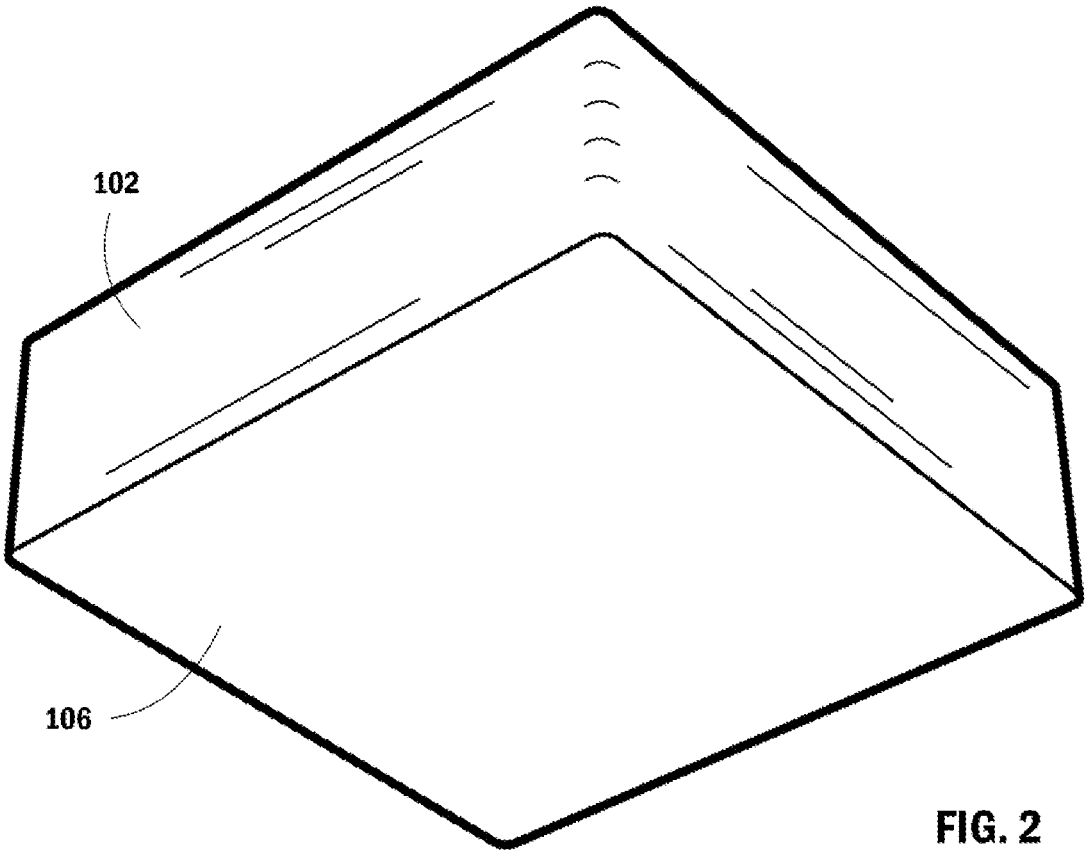
FIG. 2 is a bottom isometric perspective view of a first embodiment of an outer magnet of a tactile feedback magnetic closure device, as contemplated by the present disclosure.
Figure 3:
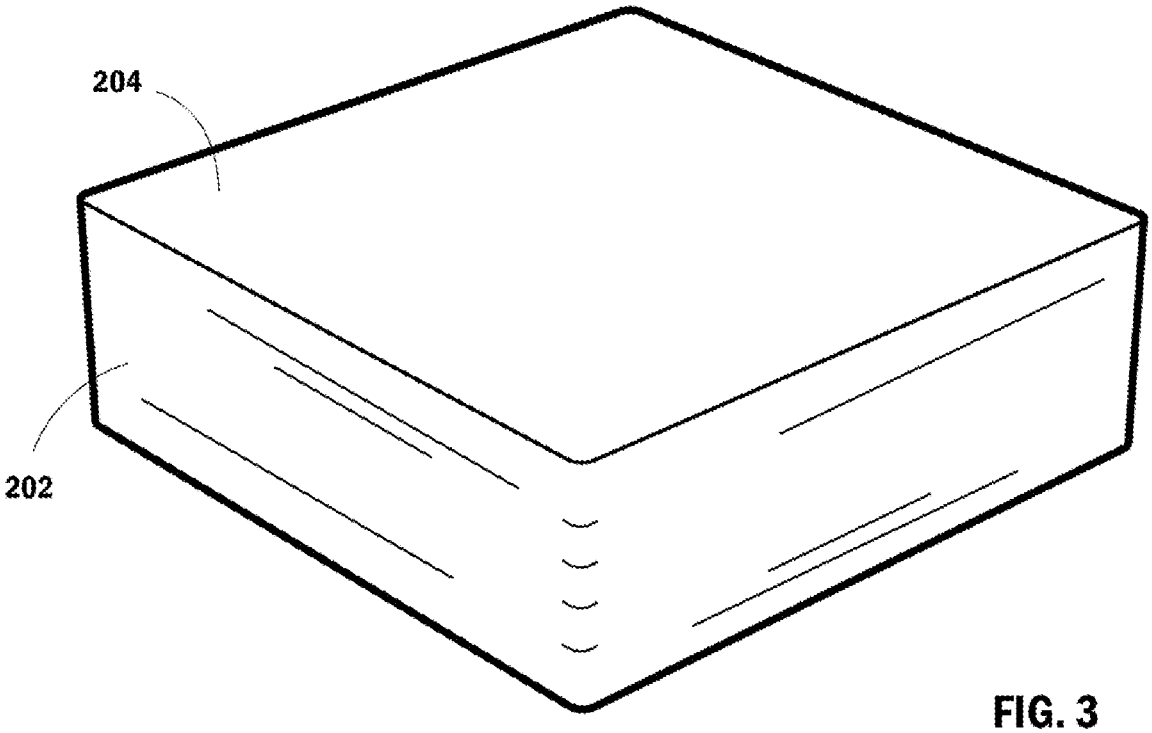
FIG. 3 is a top isometric perspective view of a first embodiment of an inner magnet of a tactile feedback magnetic closure device, as contemplated by the present disclosure.
Figure 4:
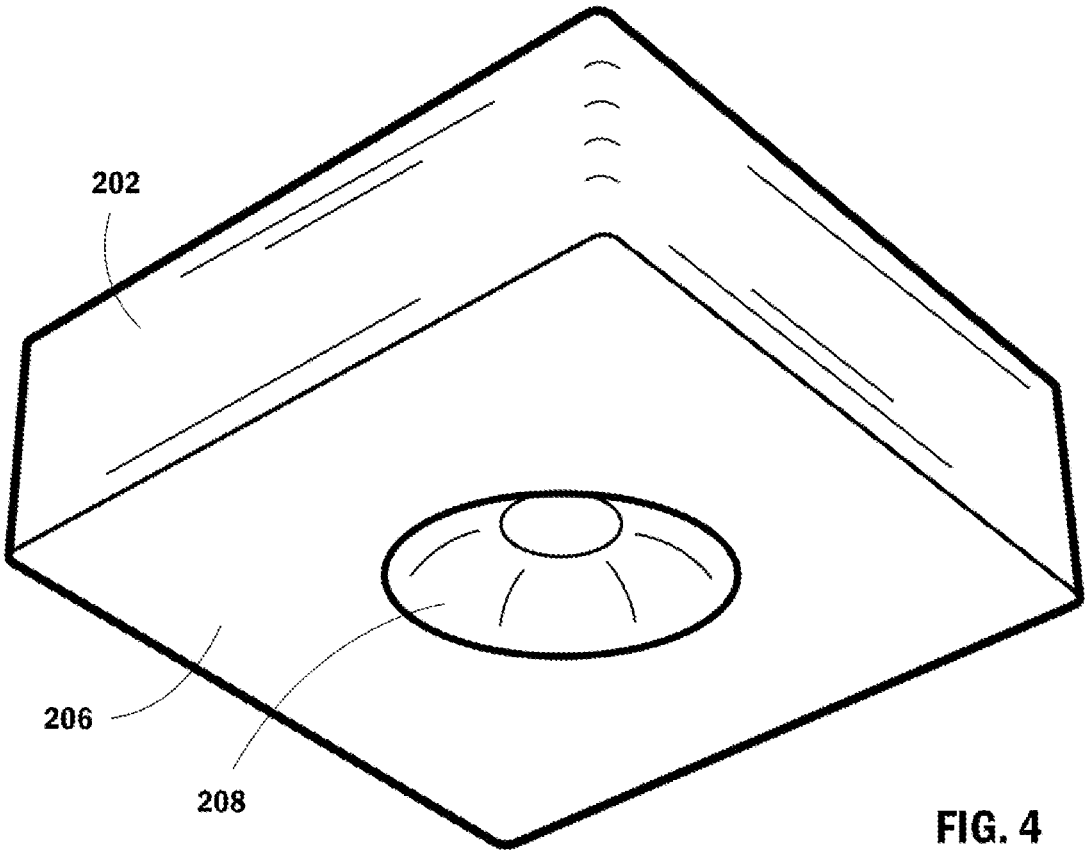
FIG. 4 is a bottom isometric perspective view of a first embodiment of an inner magnet of a tactile feedback magnetic closure device, as contemplated by the present disclosure.
Figure 5:
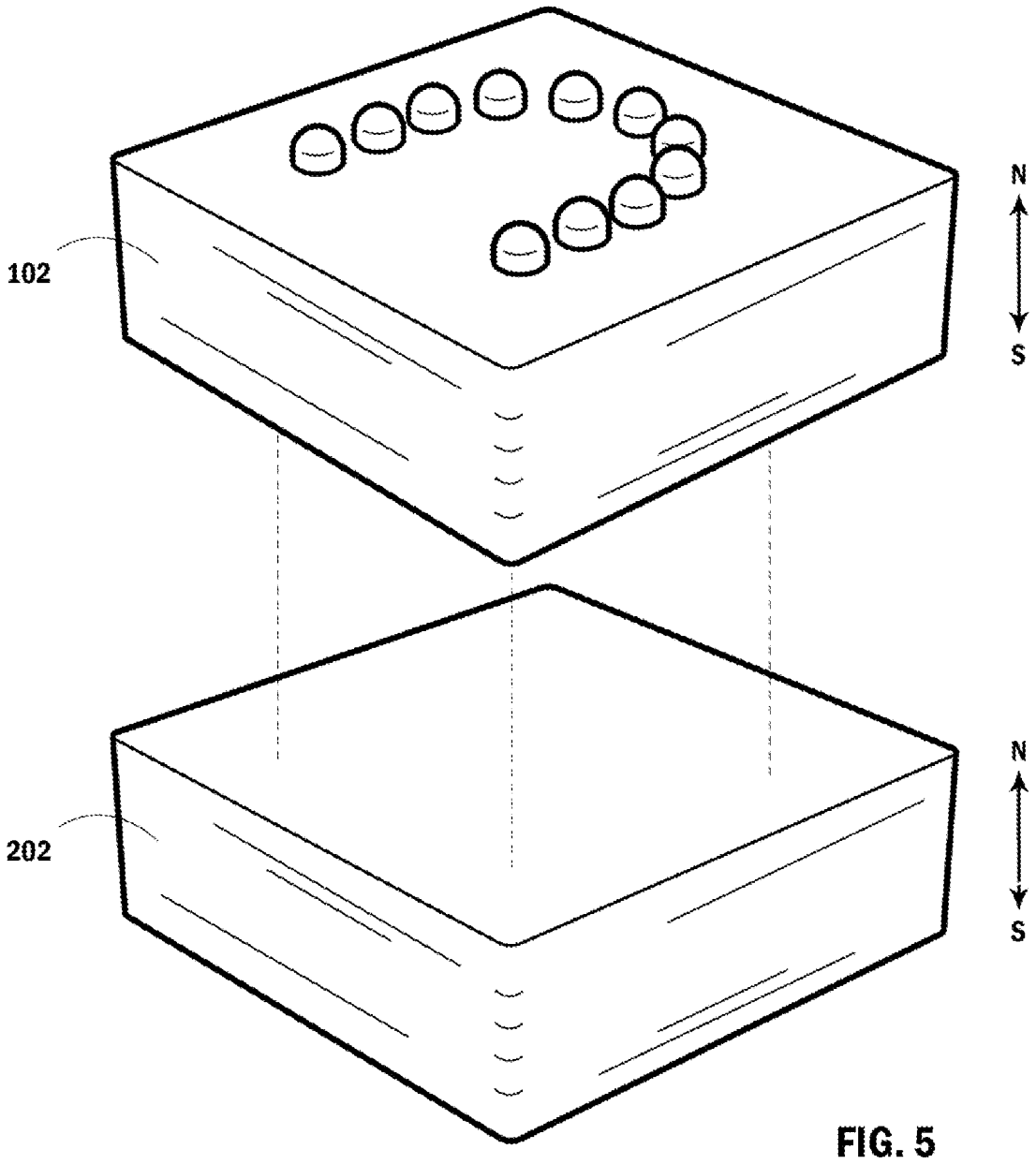
FIG. 5 is an overall view of a magnetic coupling of a first embodiment of a tactile feedback magnetic closure device, as contemplated by the present disclosure.
Figure 6:
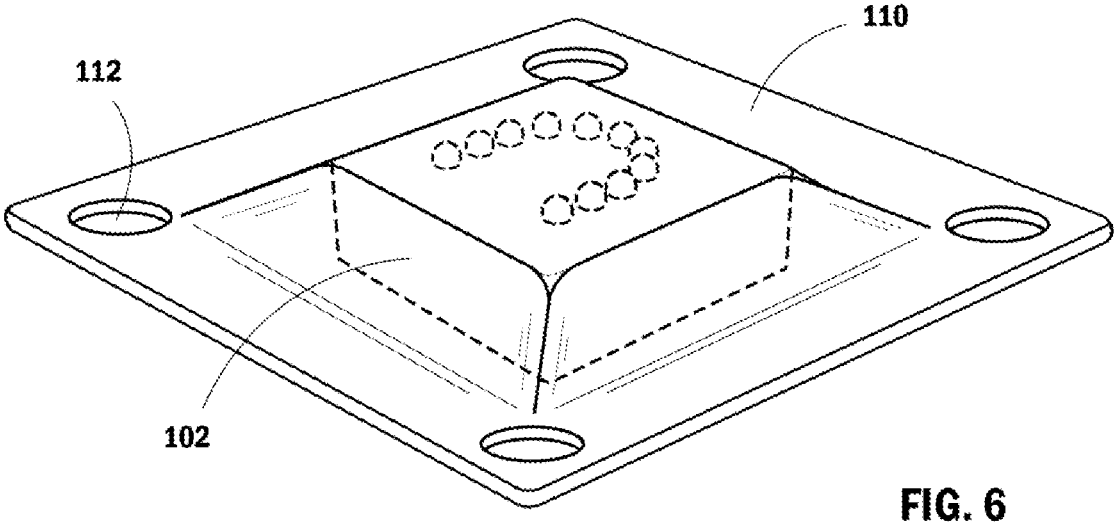
FIG. 6 is a top isometric perspective view of a first embodiment of an outer magnet enclosed in an outer enclosure of a tactile feedback magnetic closure device, as contemplated by the present disclosure.
Figure 7:
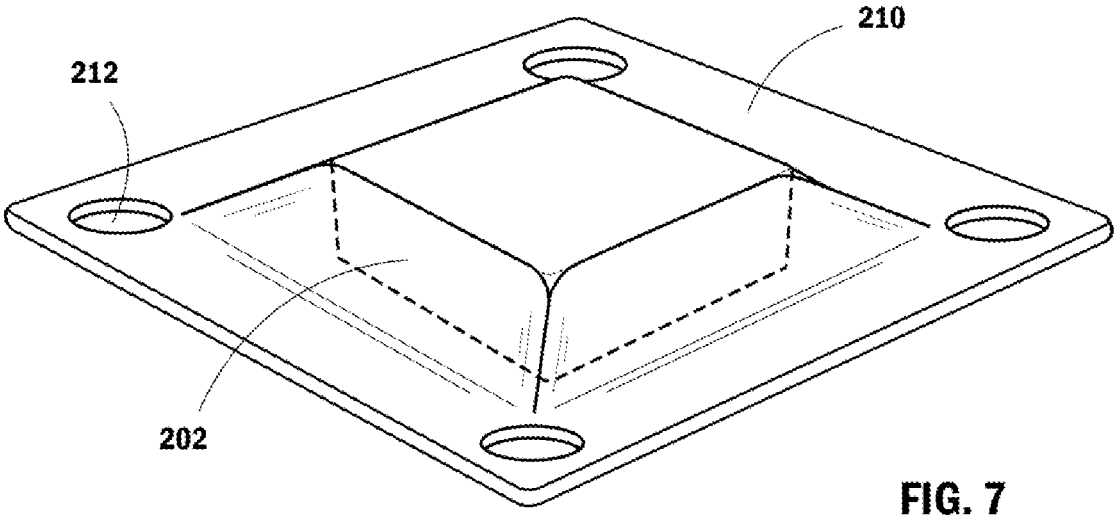
FIG. 7 is a top isometric perspective view of a first embodiment of an inner magnet enclosed in an inner enclosure of a tactile feedback magnetic closure device, as contemplated by the present disclosure.
Figure 8:
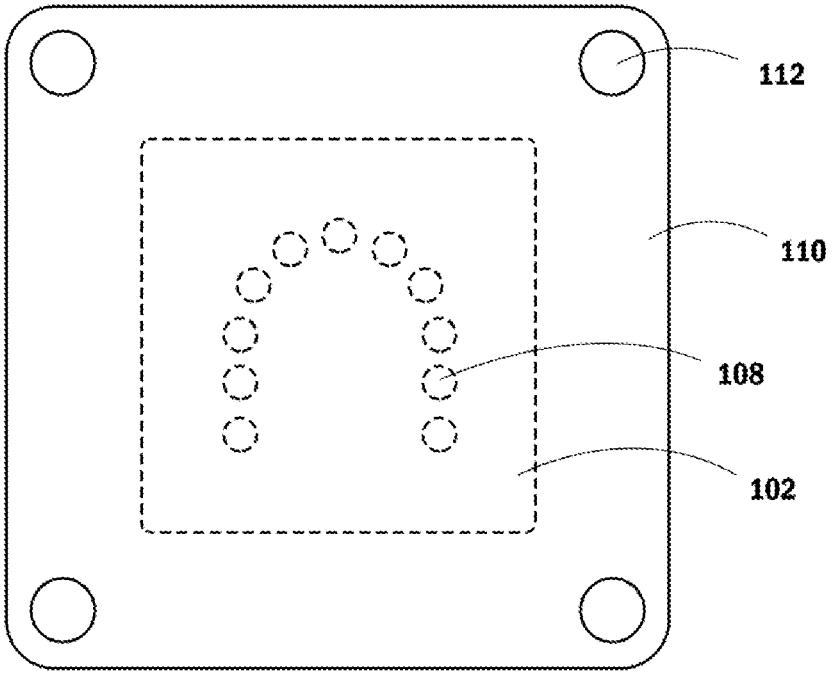
FIG. 8 is a top plan view of a first embodiment of an outer magnet enclosed in an outer enclosure of a tactile feedback magnetic closure device, as contemplated by the present disclosure.
Figure 9:
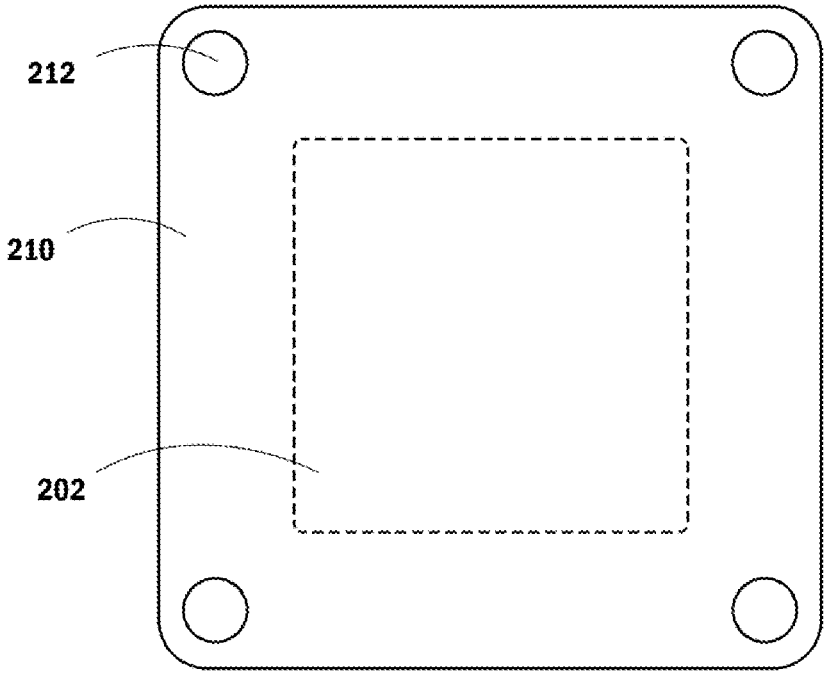
FIG. 9 is a top plan view of a first embodiment of an inner magnet enclosed in an inner enclosure of a tactile feedback magnetic closure device, as contemplated by the present disclosure.
Figure 10:
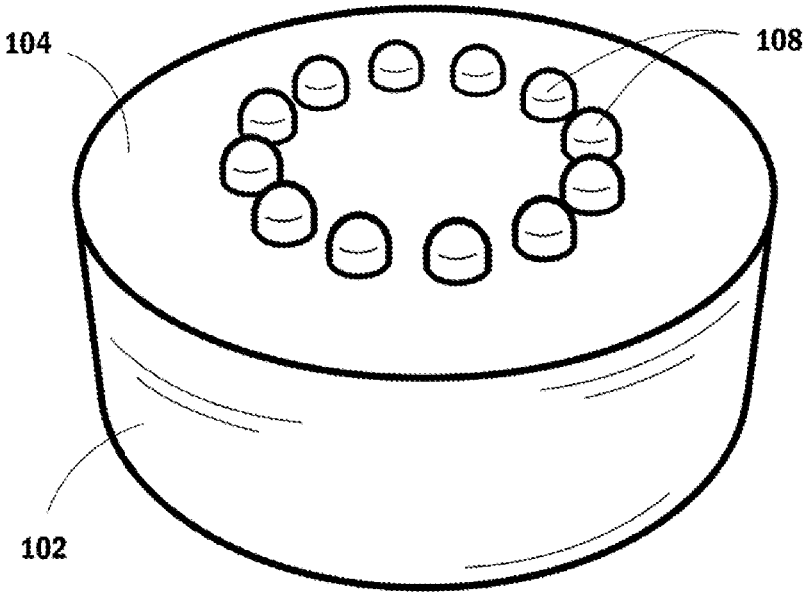
FIG. 10 is a top isometric perspective view of a second embodiment of an outer magnet of a tactile feedback magnetic closure device, as contemplated by the present disclosure.
Figure 11:
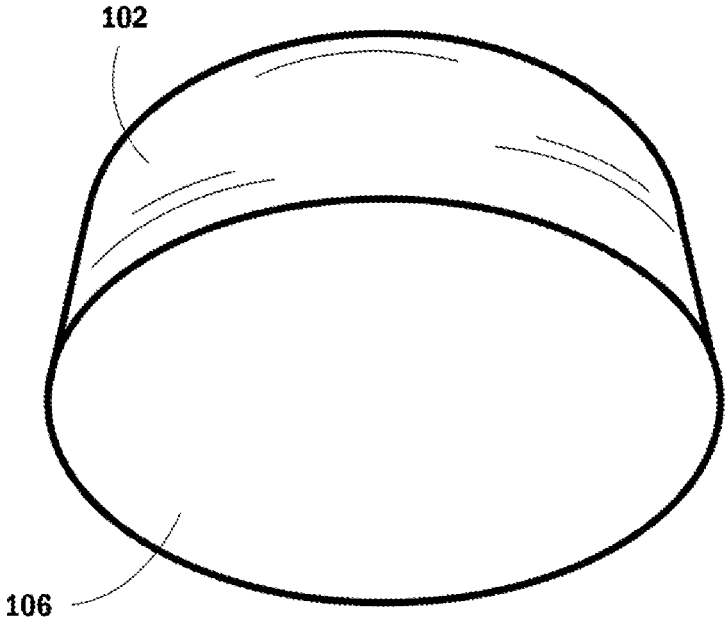
FIG. 11 is a bottom isometric perspective view of a second embodiment of an outer magnet of a tactile feedback magnetic closure device, as contemplated by the present disclosure.
Figure 12:
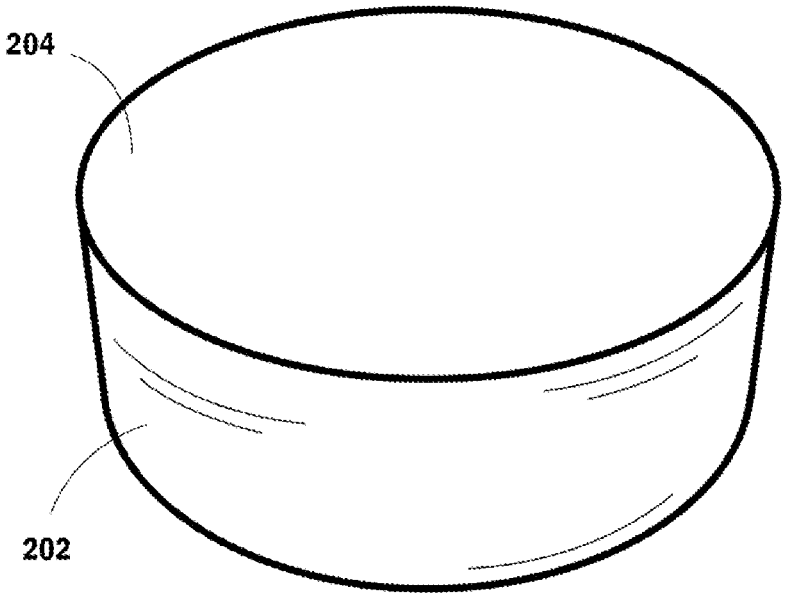
FIG. 12 is a top isometric perspective view of a second embodiment of an inner magnet of a tactile feedback magnetic closure device, as contemplated by the present disclosure.
Figure 13:
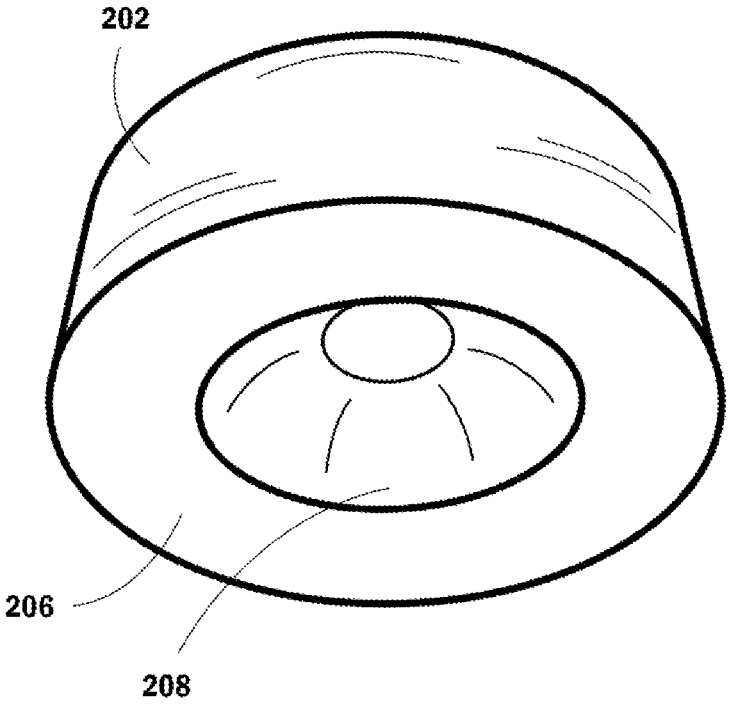
FIG. 13 is a bottom isometric perspective view of a second embodiment of an inner magnet of a tactile feedback magnetic closure device, as contemplated by the present disclosure.
Figure 14:
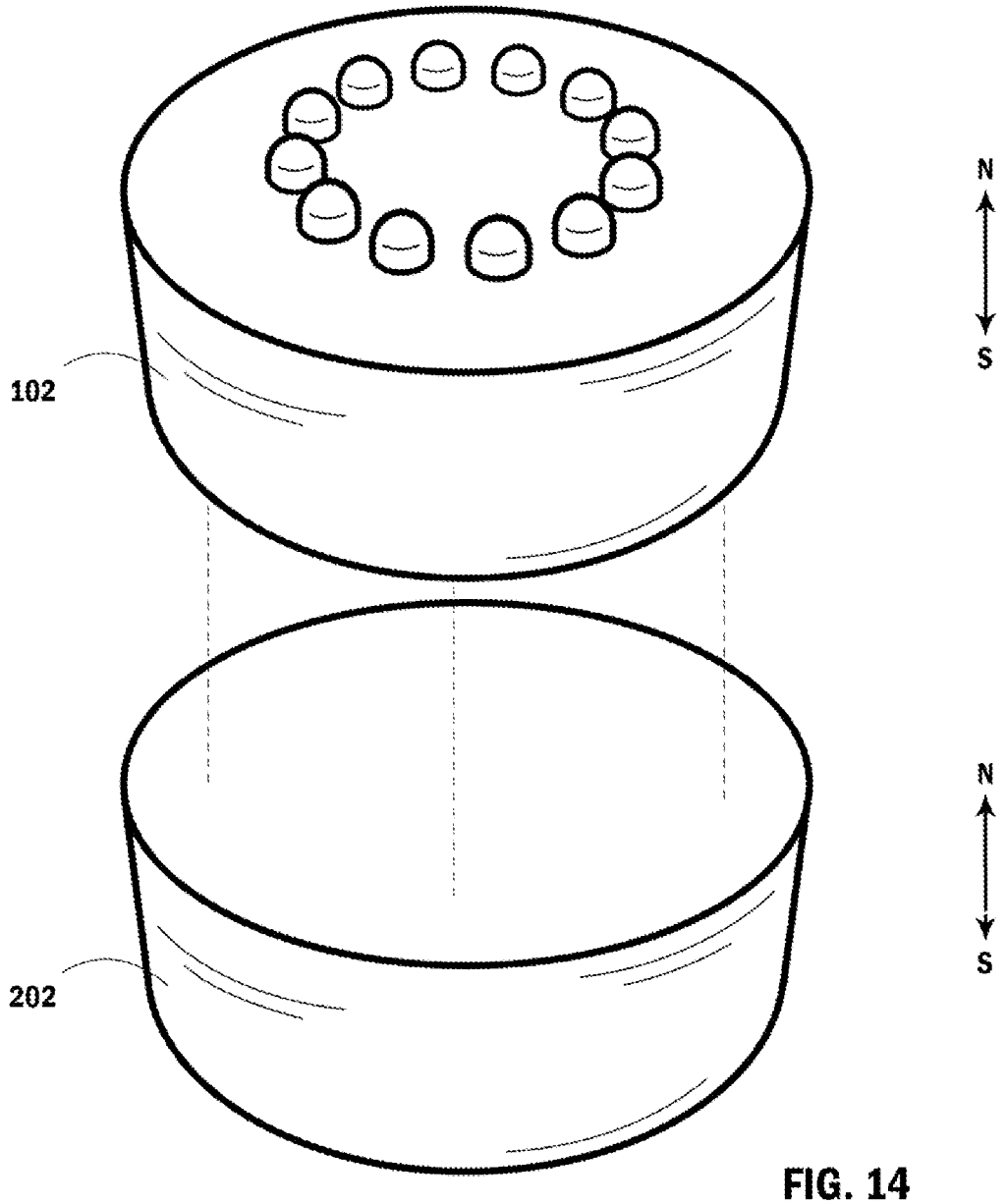
FIG. 14 is an overall view of a magnetic coupling of a second embodiment of a tactile feedback magnetic closure device, as contemplated by the present disclosure.
Figure 15:
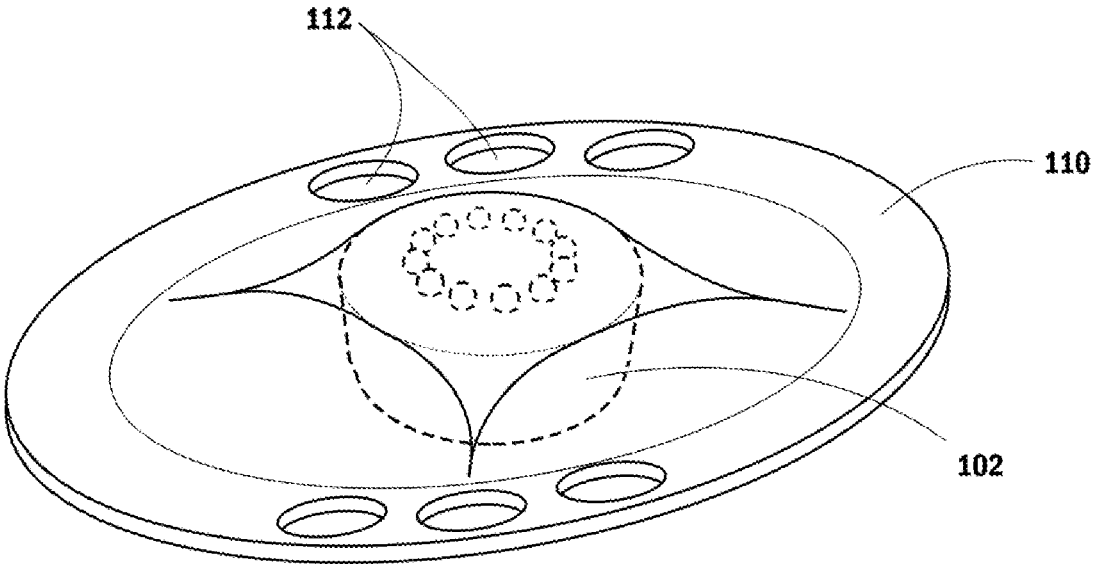
FIG. 15 is a top isometric perspective view of a second embodiment of an outer magnet enclosed in an outer enclosure of a tactile feedback magnetic closure device, as contemplated by the present disclosure.
Figure 16:
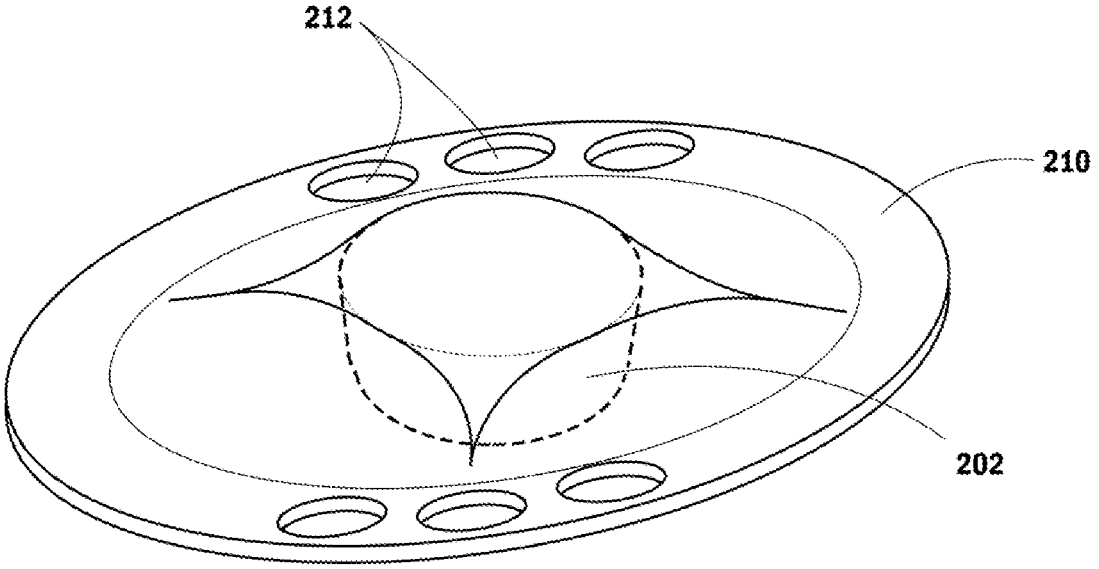
FIG. 16 is a top isometric perspective view of a second embodiment of an inner magnet enclosed in an inner enclosure of a tactile feedback magnetic closure device, as contemplated by the present disclosure.
Figure 17:
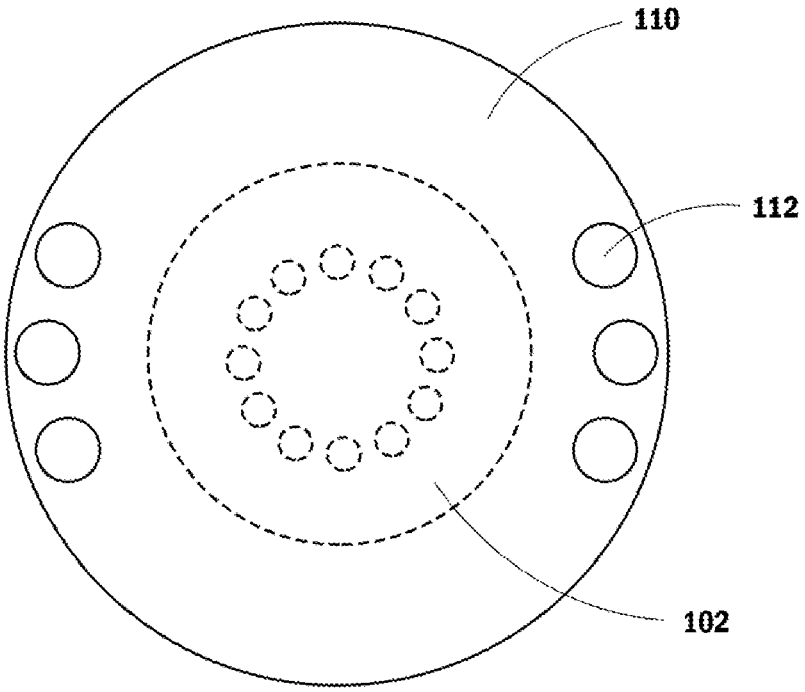
FIG. 17 is a top plan view of a second embodiment of an outer magnet enclosed in an outer enclosure of a tactile feedback magnetic closure device, as contemplated by the present disclosure.
Figure 18:
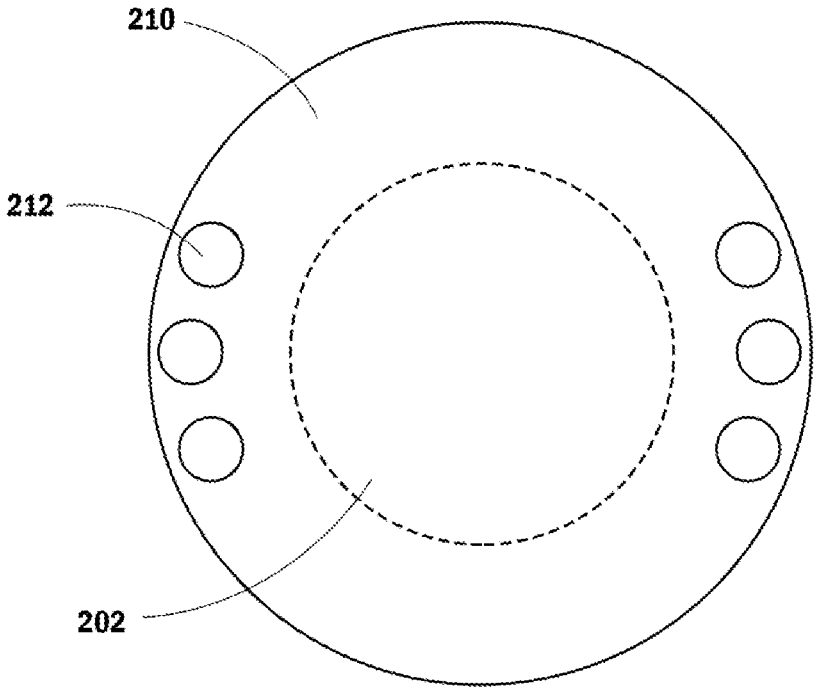
FIG. 18 is a top plan view of a second embodiment of an inner magnet enclosed in an inner enclosure of a tactile feedback magnetic closure device, as contemplated by the present disclosure.
Figure 19:
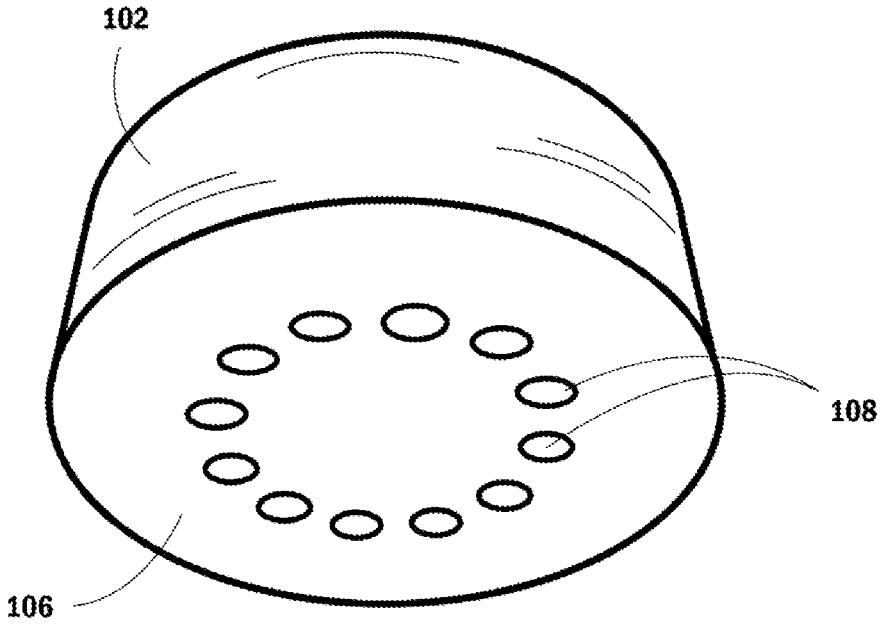
FIG. 19 is a bottom isometric perspective view of a third embodiment of an outer magnet of a tactile feedback magnetic closure device, as contemplated by the present disclosure.
Figure 20:
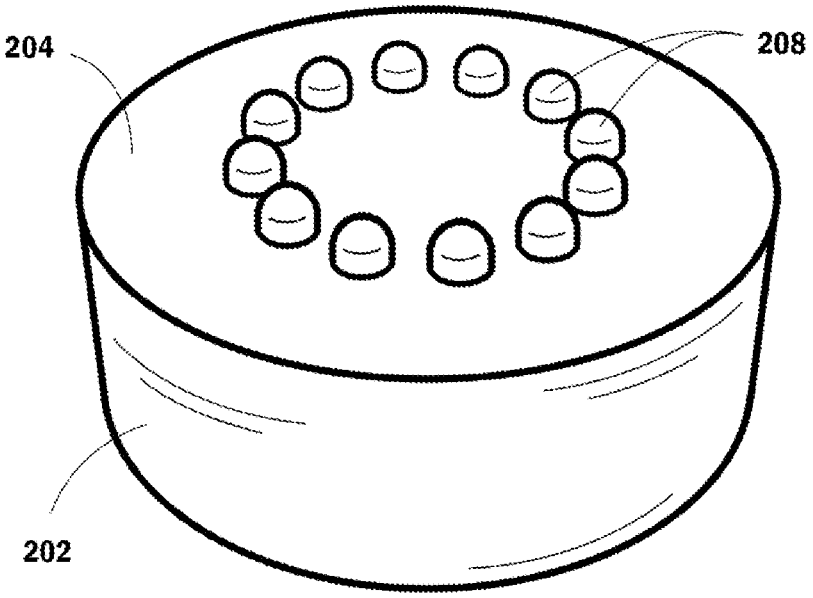
FIG. 20 is a top isometric perspective view of a third embodiment of an inner magnet of a tactile feedback magnetic closure device, as contemplated by the present disclosure.
Figure 21:
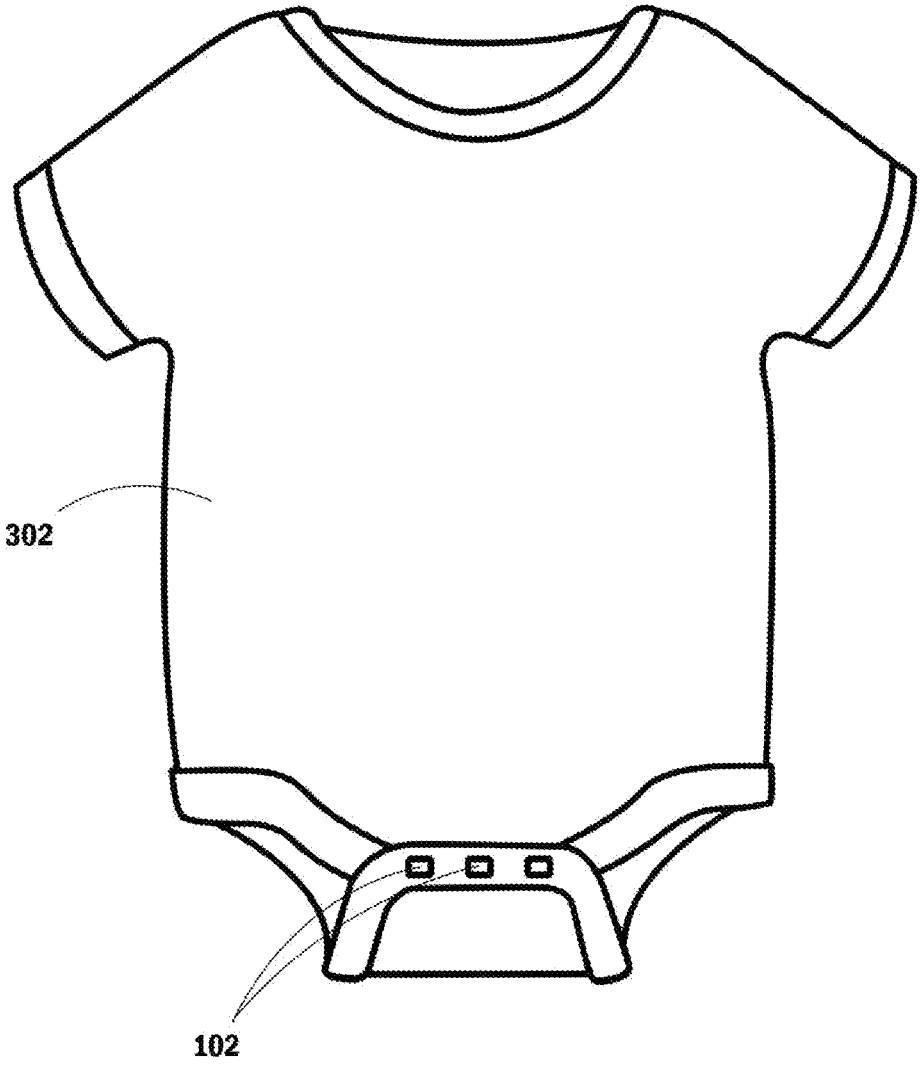
FIG. 21 is an overall view of a first embodiment of an exemplary article of clothing having a bound tactile feedback magnetic closure device, as contemplated by the present disclosure.
Figure 22:
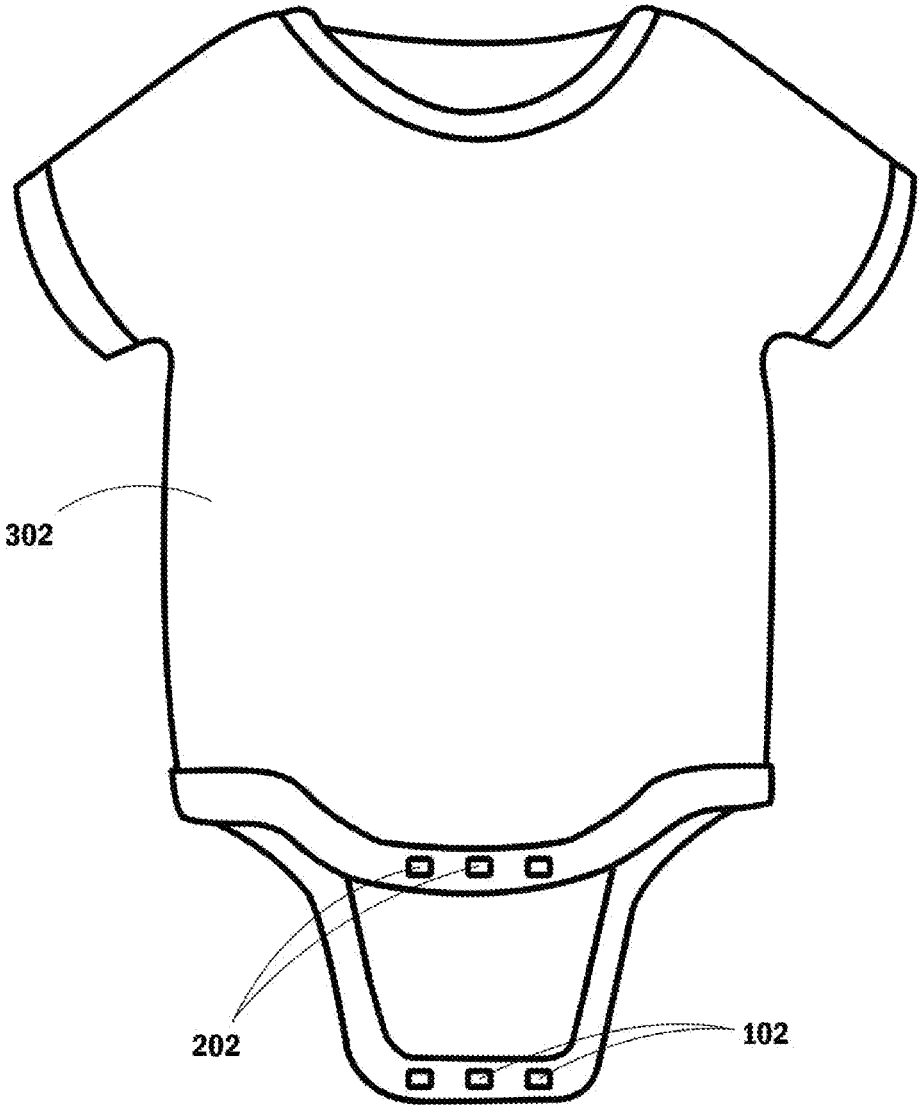
FIG. 22 is an overall view of a first embodiment of an exemplary article of clothing having an unbound tactile feedback magnetic closure device, as contemplated by the present disclosure.
Figure 23:
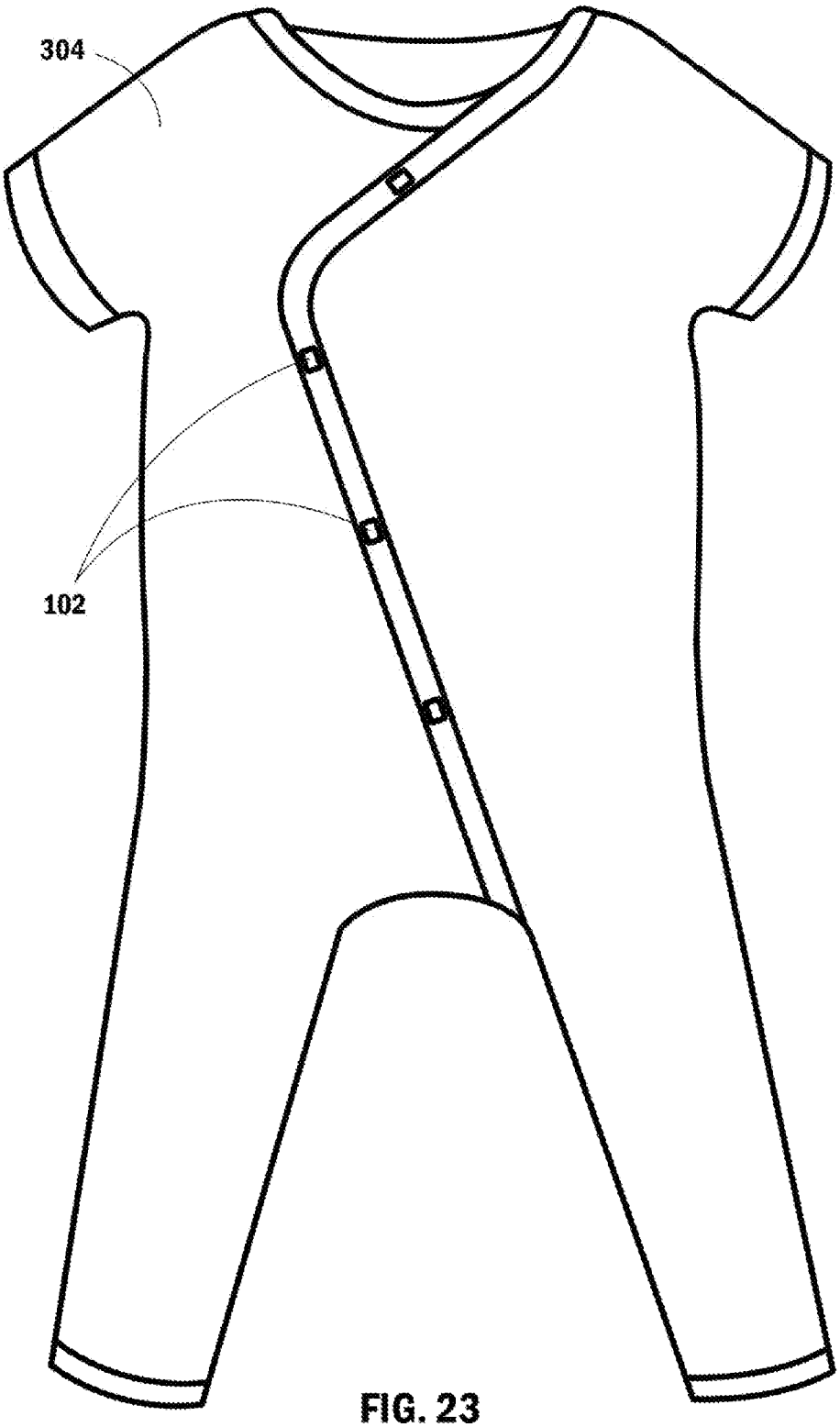
FIG. 23 is an overall view of a second embodiment of an exemplary article of clothing having a bound tactile feedback magnetic closure device, as contemplated by the present disclosure.
Figure 24:
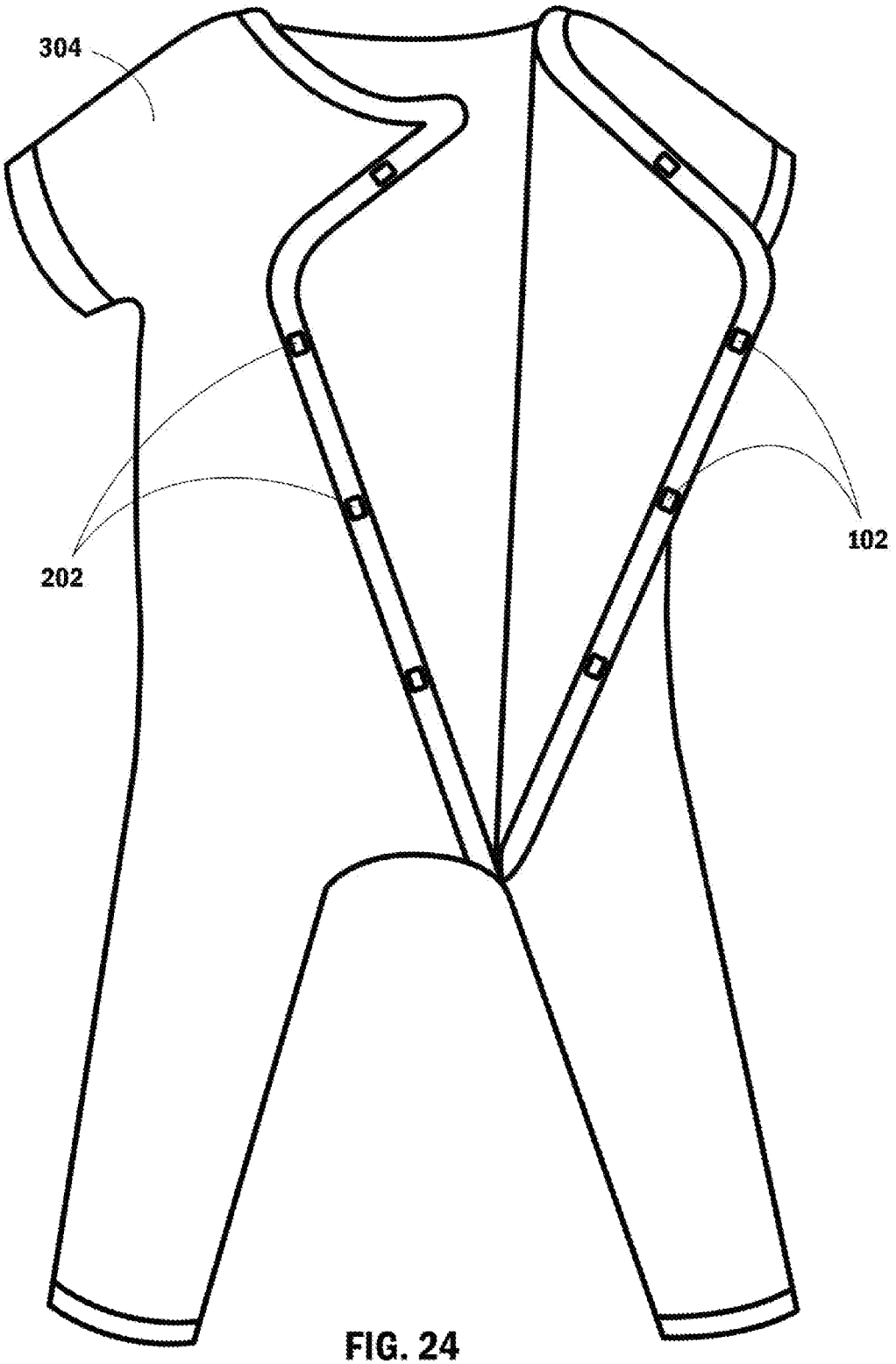
FIG. 24 is an overall view of a second embodiment of an exemplary article of clothing having an unbound tactile feedback magnetic closure device, as contemplated by the present disclosure.

The illustrations of FIGS. 1-24 illustrate a tactile feedback magnetic closure device, as contemplated by the present disclosure. The device comprises, generally, an outer magnet 102 and an inner magnet 202, which may be magnetically attracted to one another. The outer magnet 102 and inner magnet 202 may each comprise any appropriate shape such as, for example, a cube, a cylinder, a ring, or any other appropriate shape. As contemplated by the present disclosure the outer magnet 102 and inner magnet 202 may each comprise an identical shape in a specific embodiment or may comprise two different shapes in a specific embodiment. By way of example, in a first embodiment the outer magnet 102 and inner magnet 202 may both comprise a cylindrical shape while in a second embodiment the outer magnet 102 may comprise a cube shape and the inner magnet 202 may comprise a ring shape.

The outer magnet 102 may further comprise an outer north face 104 and an outer south face 106. The outer north face 104 may comprise a substantially flat surface correlating with a north pole of the outer magnet 102, and may be diametrically opposed to the outer south face 106, which may comprise a substantially flat surface correlating with a south pole of the outer magnet 102.

The inner magnet 202 may further comprise an inner north face 204 and an inner south face 206. The inner north face 204 may comprise a substantially flat surface correlating with a north pole of the inner magnet 202, and may be diametrically opposed to the inner south face 206, which may comprise a substantially flat surface correlating with a south pole of the inner magnet 202.

As contemplated by the present disclosure the implementation of substantially flat surfaces for the respective faces provides an increased magnetic binding area for a more secure attachment between the two magnets, though is not required. The magnets may be bound, for example, by the interaction of their respective projections, which are discussed in detail below.

The outer magnet 102 may further comprise a plurality of outer projections 108, which may comprise any appropriate projections such as, for example, a raised texture, a peg, a dimple, a peg receiver, a hole, or any similar mechanism. The purpose of the plurality of outer projections 108 is to provide a user with an instant tactile reference for orienting the outer magnet 102 against the inner magnet 202. The plurality of outer projections 108 and outer magnet 102 may together comprise a single component of construction, meaning that these two elements are formed from a single piece of material, or the plurality of outer projections 108 may be attached to the outer magnet 102 by any appropriate means such as, for example, welding, gluing, melting, adhering, binding, or other similar means.

The inner magnet 202 may further comprise a plurality of inner projections 208, which may comprise any appropriate projections such as, for example, a raised texture, a peg, a dimple, a peg receiver, a hole, or any similar mechanism. The purpose of the plurality of inner projections 208 is to provide a user with an instant tactile reference for orienting the outer magnet 102 against the inner magnet 202. The plurality of inner projections 208 and inner magnet 202 may together comprise a single component of construction, meaning that these two elements are formed from a single piece of material, or the plurality of inner projections 208 may be attached to the inner magnet 202 by any appropriate means such as, for example, welding, gluing, melting, adhering, binding, or other similar means.

The plurality of outer projections 108 may comprise any appropriate shape or mechanism complementary to the plurality of inner projections 208, as desired for a particular embodiment. By way of example, in a first embodiment the plurality of outer projections 108 may comprise a plurality of pegs attached to the outer north face 104, and the plurality of inner projections 208 may comprise a dimple within the inner south face 204. In a second embodiment the plurality of outer projections 108 may comprise a plurality of pegs attached to the outer north face 104, and the plurality of inner projections 208 may comprise a plurality of pegs attached to the inner south face 204. By either of these mechanisms a user is made aware of the non-mating surfaces of both magnets through their tactile sense. In a third embodiment the plurality of outer projections 108 may comprise a plurality of peg receivers attached to the outer south face 106, and the plurality of inner projections 208 may comprise a plurality of pegs attached to the inner north face 204. By such a mechanism a user is made aware of the non-mating surfaces of both magnets by the lack of tactile sense, and the two magnets may interlock with each other to form the correct bond orientation.

The outer magnet 102 may further comprise an outer enclosure 110, which may comprise any appropriate enclosure such as, for example, a plastic casing, a shrink wrap, a fabric housing, or any other appropriate enclosure. The outer enclosure 110 may further comprise a plurality of outer bindings 112, which may comprise any appropriate binding mechanism for attaching the outer magnet 102 to an article of clothing such as, for example, rings for sewing, hook and loop fasteners, button snaps, or any other appropriate binding mechanism. In one embodiment the plurality of outer projections 108 may be integrated into the outer enclosure 110, meaning that these two elements are formed from a single piece of material, or the plurality of outer projections 108 may be attached to the outer enclosure 110 by any appropriate means such as, for example, welding, gluing, melting, adhering, binding, or other similar means. The outer enclosure 110 may further comprise a waterproof material of construction so as to prevent contamination of the outer magnet 102. The outer enclosure 110 may further comprise a heat-resistant material of construction so as to prevent damage to or demagnetization of the outer magnet 102.

The inner magnet 202 may further comprise an inner enclosure 210, which may comprise any appropriate enclosure such as, for example, a plastic casing, a shrink wrap, a fabric housing, or any other appropriate enclosure. The inner enclosure 210 may further comprise a plurality of inner bindings 212, which may comprise any appropriate binding mechanism for attaching the inner magnet 202 to an article of clothing such as, for example, rings for sewing, hook and loop fasteners, button snaps, or any other appropriate binding mechanism. In one embodiment the plurality of inner projections 208 may be integrated into the inner enclosure 210, meaning that these two elements are formed from a single piece of material, or the plurality of inner projections 208 may be attached to the inner enclosure 210 by any appropriate means such as, for example, welding, gluing, melting, adhering, binding, or other similar means. The inner enclosure 210 may further comprise a waterproof material of construction so as to prevent contamination of the inner magnet 202. The inner enclosure 210 may further comprise a heat-resistant material of construction so as to prevent damage to or demagnetization of the inner magnet 202.

One or more outer magnets 102 may be attached to an outer flap of an exemplary garment 302, and one or more inner magnets 202 may be attached to an inner flap of an exemplary garment 302. The attachment of the one or more outer magnets 102 and the one or more inner magnets 202 may be such that the various magnets align themselves and bind magnetically when the outer flap of the exemplary garment 302 is correctly aligned over the inner flap.

To begin using the tactile feedback magnetic closure device a user may first wear an article of clothing to which an outer magnet 102 and an inner magnet 202 are appropriately attached. The user may then grasp the outer magnet 102 in a first hand, feeling for the plurality of outer projections 108 to confirm they have grasped the outer magnet 102 and, thus, an outer flap of the clothing. The user may then grasp the inner magnet 202 in a second hand, feeling for the plurality of inner projections 208 to confirm they have grasped the inner magnet 202 and, thus, an inner flap of the clothing. The user may then orient the outer magnet 102, and the outer flap of the clothing, over the inner magnet 202, and the inner flap of the clothing, and the magnetism of the two magnets may complete the attachment. By this mechanism the user may be able to correctly orient the two magnets purely through their tactile sense.

The tactile feedback magnetic closure device may be substantially constructed of any suitable material or combination of materials, but typically is constructed of a resilient material or combination of materials such that the device is easily manufactured, magnetic, and reusable. As an example, and without limiting the scope of the present invention, various exemplary embodiments of the tactile feedback magnetic closure device may be substantially constructed of one or more materials of alnico, ferrite, neodymium, samarium, plastic, acrylic, polyethylene, polypropylene, polycarbonate, fabric, denim, steel, aluminum, brass, fiberglass, carbon fiber, or combinations thereof. In some embodiments the various components of the device may be coated, lined, or otherwise insulated to prevent contamination of the device.

In one embodiment the tactile feedback magnetic closure device may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, antiviral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

We claim:

1. A tactile feedback magnetic closure device, comprising:
an outer magnet; and
an inner magnet;
wherein said outer magnet comprises a magnetic polarity;
wherein said outer magnet further comprises an outer north face and an outer south face;
wherein said inner magnet comprises a magnetic polarity;
wherein said inner magnet further comprises an inner north face and an inner south face;
wherein said outer magnet further comprises a plurality of outer projections;
wherein said inner magnet further comprises a plurality of inner projections;
wherein said outer magnet further comprises an outer enclosure;
wherein said outer enclosure further comprises a plurality of outer bindings;
wherein said inner magnet further comprises an inner enclosure; and
wherein said inner enclosure further comprises a plurality of inner bindings.

2. The magnetic closure of claim 1,
wherein said plurality of outer projections comprise a plurality of pegs attached to said outer enclosure; and
wherein said plurality of inner projections comprise a dimple attached to said inner enclosure.

3. The magnetic closure of claim 1,
wherein said plurality of outer projections comprise a plurality of pegs attached to said outer enclosure; and
wherein said plurality of inner projections comprise a plurality of pegs attached to said inner enclosure.

4. The magnetic closure of claim 1,
wherein said plurality of outer projections comprise a plurality of peg receivers attached to said outer enclosure; and
wherein said plurality of inner projections comprise a plurality of pegs attached to said inner enclosure.

5. The magnetic closure of claim 1,
wherein said outer enclosure further comprises a hard plastic case; and
wherein said inner enclosure further comprises a hard plastic case.

6. The magnetic closure of claim 1,
wherein said outer enclosure further comprises a soft plastic case; and
wherein said inner enclosure further comprises a soft plastic case.

7. The magnetic closure of claim 1,
wherein said outer enclosure further comprises a flexible plastic wrap; and
wherein said inner enclosure further comprises a flexible plastic wrap.

8. The magnetic closure of claim 1,
wherein said outer enclosure further comprises a fabric wrap; and
wherein said inner enclosure further comprises a fabric wrap.

9. The magnetic closure of claim 1,
wherein said plurality of outer bindings further comprise a plurality of sewing loops; and
wherein said plurality of inner binding further comprise a plurality of sewing loops.

10. The magnetic closure of claim 1,
wherein said plurality of outer bindings further comprise a plurality of hook and loop fasteners; and
wherein said plurality of inner binding further comprise a plurality of hook and loop fasteners.

* * * * *